United States Patent [19]

Moreau et al.

[11] Patent Number: 4,535,309

[45] Date of Patent: Aug. 13, 1985

[54] MAGNETO-THERMAL DEVICE FOR OVERCURRENT RELAYS

[75] Inventors: Dominique Moreau, Saint Germain en Laye; Pierre Duchemin, Fourqueux; Jean-Pierre Duchemin, Jouy le Moutier, all of France

[73] Assignee: La Telemecanique Electrique, Nanterre, France

[21] Appl. No.: 581,160

[22] Filed: Feb. 17, 1984

[30] Foreign Application Priority Data

Feb. 23, 1983 [FR] France ..... 83 02909

[51] Int. Cl.[3] ..... H01H 75/10

[52] U.S. Cl. ..... 335/42; 335/45; 337/54; 337/75

[58] Field of Search ..... 335/38, 39, 40, 42–45; 337/71, 75, 54

[56] References Cited

U.S. PATENT DOCUMENTS 1,825,312 9/1931 Evans ..... 335/45

*Primary Examiner*—E. A. Goldberg
*Assistant Examiner*—George Andrews
*Attorney, Agent, or Firm*—William A. Drucker

[57] ABSTRACT

The invention provides a magneto-thermal device for overcurrent relays.

The end of a core, whose axial position may be adjusted with respect to a mobile plate, placed opposite and pivoting about one end of the yoke, is secured against movement by a wedge which is guided in a groove belonging to a flange of the coil shell.

This device may be used in any thermal relay where a stable and precise adjustment of the tripping current threshold is desired.

5 Claims, 5 Drawing Figures

MAGNETO-THERMAL DEVICE FOR OVERCURRENT RELAYS

BACKGROUND OF THE INVENTION

1. Field of the Invention

The invention relates to a magneto-thermal device for causing a safety switch to open when the current which flows therethrough presents either an excessive instantaneous current or a smaller current but of too long a duration; this device comprises a bimetallic strip, a magnetizable yoke with which are associated: on the one hand, a screwed adjustable core which is surrounded by a coil and, on the other hand, a plate angularly movable about one end of the yoke for cooperating with one end of said core placed substantially at the same level and against a return spring, and locking means associated with said core for providing the adjustment position.

Such devices are widely used in apparatus, generally called thermal relays, which are intended for monitoring the currents flowing in a load, particularly in an electric motor, for interrupting its power supply when the current which it consumes takes on abnormal values.

2. Description of the Prior Art

In devices whose construction corresponds to the one mentioned above, it is necessary to adjust the core so that the intensity of the current which flows in the coil causes the plate to be attracted when a well-defined current threshold is reached; this current threshold which is determined as a function of the characteristics proper to each motor, causes tripping, as a function of the different geometrical parameters of the coil, of the magnetic circuit and of the return spring, which are subject to slight variations during mass production; furthermore, an adjustment carried out in the factory so that the finished apparatus has the desired protection properties, must be kept during fitting and thereafter when either mechanical or thermal stresses or ageing of the materials of the apparatus or of its case appear.

Among the adjustments whose importance is preponderant are those which influence the dimensions of the air-gaps which exist between the end of the core, the plate and the end of the yoke; modification of the first of these air-gaps must especially not influence the second one. In some known devices, adjustment of the respective position of the active end of the core and of the plate is provided by moving an opposite threaded end into a threaded opening in the yoke, whereas locking of the chosen adjustment is provided by means of a lock-nut which is engaged against this threaded end. Such a known device has the disadvantage of a drive being possibly communicated to the core at the time when a locking torque is communicated to the nut; when the pitch of the thread is fine, such a drive is small, but, even in this case, it is not excluded that the locking forces may cause a slight lateral movement of the active end and modify the leak air-gap which exists between it and the end of the yoke.

The invention consequently provides a device conforming to the one whose construction is mentioned above but in which measures will be taken so that the means for locking the core do not modify the lateral position of the active end of the core and ensure permanence of the adjustment effected.

SUMMARY OF THE INVENTION

According to the invention, the desired result is obtained because, in a plane perpendicular to the axis of the core and adjacent the end of the yoke serving as a pivot for the plate, a flat non magnetizable piece is placed under radial compression between the end of the core and a face of the leg of the yoke situated opposite, the radial dimension of this piece being slightly greater than the distance which separates said end and said face in the absence of said piece.

BRIEF DESCRIPTION OF THE DRAWINGS

The invention, as well as complementary measures for facilitating the whole of the adjustments of the device and for simplifying manufacture thereof, will be better understood from reading the following description.

In the accompanying drawings.

DESCRIPTION OF THE PREFERRED EMBODIMENT

Figure 1:
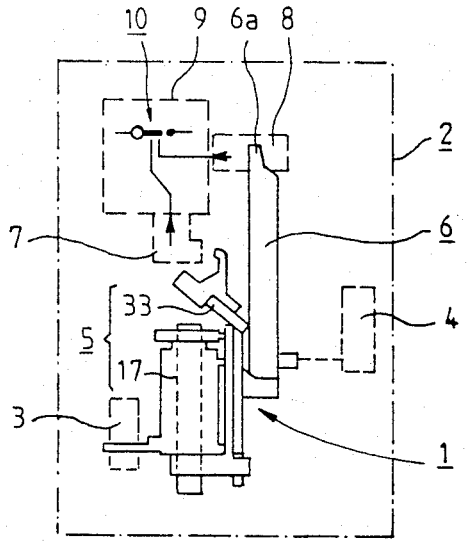
FIG. 1 represents a schematical view of the device associated with a protection apparatus.

A magneto-thermal device 1, shown in FIG. 1, is for example disposed inside a protection apparatus 2, so that a current flowing through a load and between terminals 3 and 4 passes through a magnetic relay 5 and a bi-metallic strip placed in series. A mobile plate 33 of this relay and a mobile end 6*a* of said bi-metallic strip transmit the movements or deformations which they undergo (possibly through retarder means 7 or association means 8 common to several identical bi-metallic strips) to a quick-trip mechanism or member 9 whose release causes a safety switch 10 to open. The terminals of this switch, which have not been shown, are themselves associated with a control circuit adapted for establishing or interrupting the power supply of the load, in a known way.

Figure 2:
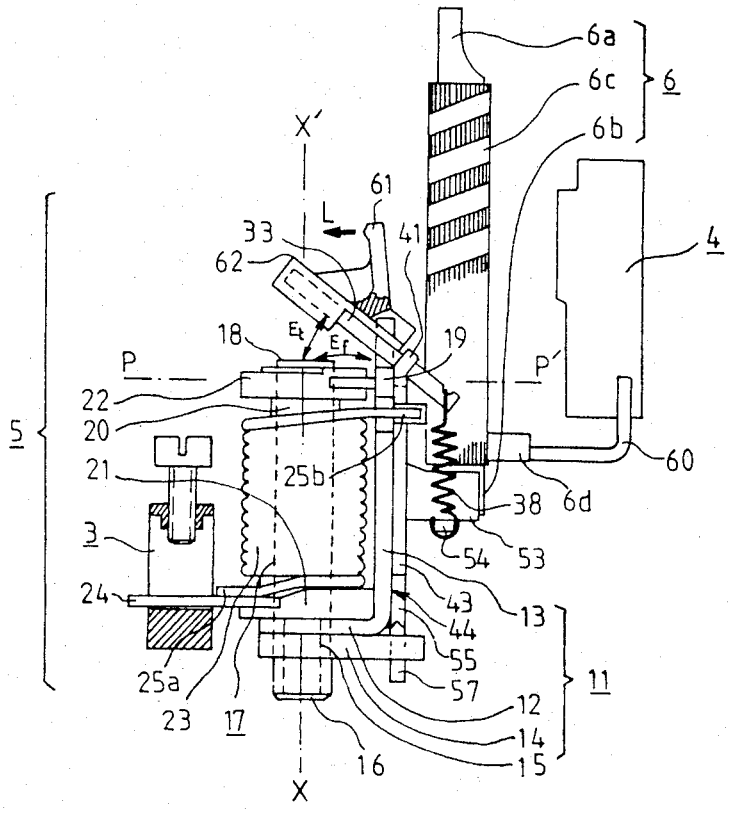
FIG. 2 is an elevational view of the device.

Relay 5, shown in FIG. 2, comprises a magnetizable yoke 11 having two perpendicular legs 12 and 13, the shortest of which 12 is, in the embodiment shown, welded to a support plate 14. One of the pieces 12 or 14, or even both, have a fine pitch threaded opening 15 with axis XX' which is adapted to receive a first threaded end 16 of a magnetizable core 17, a second opposite end 18 of which is substantially opposite an end 19 of leg 13.

On this core is fitted an insulating shell 20, on which a winding 23 is wound between two flanges 21,22 of the shell. The lower flange 21 adjacent leg 12 supports a conducting piece 24 which is associated with terminal 3 and is welded to one end 25*a* of the wire of the coil.

Figure 4:
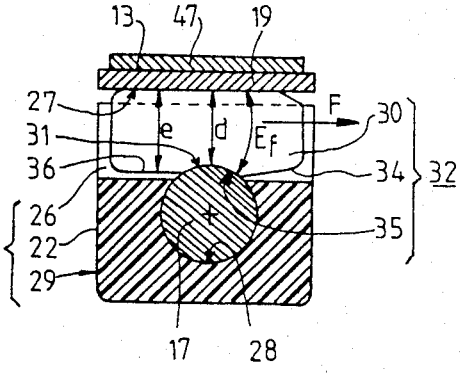
FIG. 4 is a view of the device in partial section through plane PP' of FIGS. 2 and 3.
Figure 5:
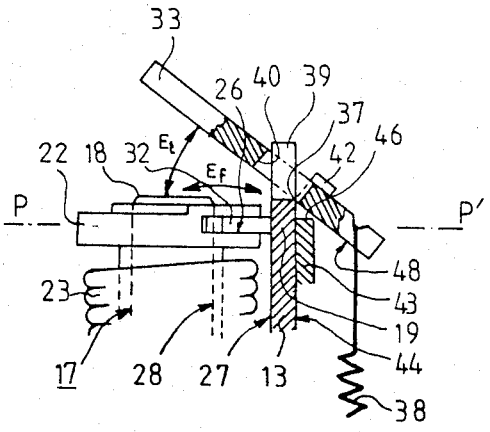
FIG. 5 shows an enlargement of the upper region of the magnetic relay.

The upper flange 22 has, in a plane PP' adjacent end 19 and substantially perpendicular to the axis XX', see FIGS. 4 and 5, a groove 26 which is open in the direction of the internal face 27 of leg 13 and which extends as far as the inner bore 28 of the shell. This groove, which is open laterally at least towards one side 29 of flange 22, see FIG. 4, receives a flat metallic non magnetizable piece 30 made for example from aluminium, brass or stainless steel. This piece, which may slide in the groove in the manner of a wedge 32, has a radial dimension "d" greater than the distance separating face 27 of the cylindrical surface 31 of core 17 placed opposite, this distance being measured when piece 30 is not fitted.

The result is that this piece 30 is placed under compression when it is in position, or when the core 17 is subjected to a stress perpendicular to the axis XX'; a resilient jamming effect of core 17 is then caused in the region where the threaded end 16 and opening 15 cooperate.

When, in the absence of complementary measures, a rotation is communicated to the core so as to modify the value of the working air-gap Et which separates the end 18 from a mobile plate 33, there is a risk of wedge 32 sliding in groove 26 because of the friction force which is communicated thereto.

Piece 30 comprises consequently a bevelled region 34 which is followed first of all by a notch 35, then by a rectilinear wall 36; said wall and said bevelled region have widths "e" slightly greater than the distance "d"; engagement of piece 30 is effected in the direction of arrow F while producing slight resilient deformation of the core and of leg 13, until notch 35 snaps on to surface 31 of the end 18 of core 17.

The magnetizable plate 33 which was mentioned above pivots about an edge 37 placed at the end 19 of leg 13, perpendicularly to axis XX' and is subjected to a return force delivered by a spring 38.

Figure 3:
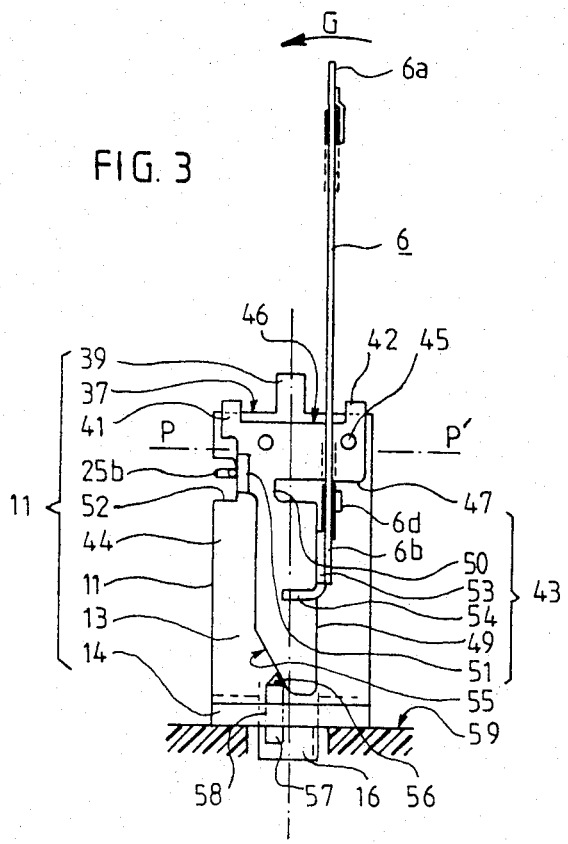
FIG. 3 is a side view of the device of FIG. 2.

Holding this plate and guiding it in the rest position are achieved, on the one hand, by a tongue 39 which is placed in the axial extension of leg 13 so as to pass through an aperture 40 in this plate and, on the other hand, by means of two lugs 41,42 which laterally surround this latter, see FIGS. 3 and 5.

So as to ensure the quality of the pivot formed by edge 37, the two lugs 41,42 are carried by a flat cutout piece 43, which is fixed to the outer end 44 of leg 13, for example by spot-welds 45; a slot 46, which is located between lugs 41,42 at the upper part, is placed lower than edge 37 and at a level such that no material contact is established with the lower face 48 of this plate. The presence of this piece 43 has been used to serve as an adjustable support for the bi-metallic strip 6, because of the bent shape which it has been given.

The transverse portion 47 of piece 43 with lugs 41,42 and the spot-welds 45 is connected to a substantially perpendicular extension 49 by a constricted portion 50. This constricted portion is adjacent a first bent tab 51 which is connected to the end *25b* of the winding passing through an indentation 52 in leg 13 of the yoke, whereas a second bent tab 53, equipped with a finger 54 for hooking thereon spring 38, is carried by the extension 49. Furthermore, one edge 55 of extension 49, which is slanting with respect to axis XX', is placed against the end 56 of the screw 57, whose axis is parallel to XX', which is engaged in a threaded opening 58 in plate 14. This plate comprises finally fixing means, not shown, which allow it to be associated rigidly with a fixed wall 59 of the apparatus. The position of the upper end *6a* of the bi-metallic strip 6, which is parallel to axis XX', and whose lower end *6b* is fixed to tab 53, may be adjusted in the direction G through a lateral movement effected by edge 55 when screw 57 is moved along its axis; this movement is made possible by the resilient deformation which the constricted portion 50 may undergo. The distribution of the magnetic masses of the yoke and of the plate is not substantially modified by the movements of the extension 49 because of the position of this latter against the external face 44 and because of the presence of wedge 32, whereas the presence of the transverse welded portion 47 of piece 43 in the region of plane PP' confers on region 19 of leg 13 a rigidity which might have been compromised by the presence of the indentation 52.

In a way known per se, a first end of a heater *6c* is connected to the end *6a* of the bi-metallic strip, whereas a second end *6d* is connected by a conductor 60 to terminal 4, see FIGS. 2 and 3.

The angular movement of plate 33 is communicated, in direction L, by a pusher 61 integral with a plastic material cover 62 which is fixed to this plate.

It can be seen, in particular from FIG. 4, that the leak flux which passes through the air-gap $E_f$ keeps, because of the presence of wedge 32, a well-defined value, even if the fixing means for associating relay 5 with case 59 of the apparatus or the action of screw 57 on leg 13 produce slight deformations of the yoke. Finally, if it is desired that axis XX' of the core be perfectly parallel to the plane of leg 13 of the yoke, after positioning of the wedge, the axis of the threaded opening 15 may be given a direction forming with this plane, and before positioning of the wedge, a small angle whose apex is placed on the side opposite this opening.

What is claimed is:

1. A magneto-thermal device adapted for causing the opening of a safety switch when the current which passes therethrough presents either an excessive instantaneous intensity or a smaller intensity but of too long a duration, said device comprising a bi-metallic strip, a magnetizable yoke with which are associated, on the one hand, an adjustable screwed core which is surrounded by a coil and, on the other hand, a plate angularly movable about one end of the yoke for cooperating with an end of this core placed substantially at the same level and against a return spring, and locking means associated with this core for ensuring the adjustment position, wherein, in a plane PP' perpendicular to the axis XX' of the core and adjacent the end of the yoke serving as a pivot for the plate said locking means comprising a flat non magnetizable piece which is placed under radial compression between the end of the core and a face of a leg of the yoke situated opposite thereto, the radial dimension of said piece being slightly greater than the distance which separates said end and said face in the absence of said piece.

2. The magneto-thermal device as claimed in claim 1, wherein said non magnetizable flat piece is guided in its plane PP' by a groove which is placed in a flange of the shell of the coil and extends as far as the inner bore of said shell receiving the adjustable core.

3. The magneto-thermal device as claimed in claim 1, wherein said non magnetizable flat piece has the shape of a wedge with a bevelled edge followed by a notch adapted for cooperation with the endmost cylindrical surface of said core.

4. The magneto-thermal device as claimed in claim 1, wherein said non magnetizable flat piece bears on an internal surface of the end of the leg of said yoke which is opposite an external face bearing means for supporting and adjusting said bi-metallic strip.

5. The magneto-thermal device as claimed in claim 4, wherein said support means comprise a first transverse portion which is firmly secured to said leg substantially in the plane PP' of the flat piece and a second axial portion which is connected to a first one by a constricted portion capable of being deformed by the action of a screw parallel to the axis XX' of the mobile core, the bi-metallic strip being fixed axially to this second portion.

* * * * *